US011708719B1

(12) United States Patent
Woods et al.

(10) Patent No.: US 11,708,719 B1
(45) Date of Patent: Jul. 25, 2023

(54) PUBLIC BATHROOM DOOR GAP COVER

(71) Applicants: Lorena A. Woods, Lithia, FL (US); Kenneth E. Woods, Lithia, FL (US); Kinya C. Woods, Lithia, FL (US)

(72) Inventors: Lorena A. Woods, Lithia, FL (US); Kenneth E. Woods, Lithia, FL (US); Kinya C. Woods, Lithia, FL (US)

( * ) Notice: Subject to any disclaimer, the term of this patent is extended or adjusted under 35 U.S.C. 154(b) by 0 days.

(21) Appl. No.: 17/683,520

(22) Filed: Mar. 1, 2022

(51) Int. Cl.

| | |
|---|---|
| ***E06B 7/28*** | (2006.01) |
| ***A47H 1/18*** | (2006.01) |
| ***E04H 1/12*** | (2006.01) |
| ***E06B 7/36*** | (2006.01) |
| *E05D 11/00* | (2006.01) |

(52) U.S. Cl.
CPC ..... *E06B 7/28* (2013.01); *A47H 1/18* (2013.01); *E04H 1/1266* (2013.01); *E06B 7/367* (2013.01); *E05D 2011/0072* (2013.01)

(58) Field of Classification Search
CPC . E06B 7/28; E06B 7/367; F16B 45/00; A47H 21/00; A47H 1/00; A47H 1/18; E05D 2011/0072
USPC ..... 52/717.01, 239, 205, 459; 49/490.1; 16/250
See application file for complete search history.

(56) References Cited

U.S. PATENT DOCUMENTS

| | | | | |
|---|---|---|---|---|
| 8,627,610 | B1 | 1/2014 | Crowther | |
| 9,347,259 | B2 * | 5/2016 | Ferguson | A47K 17/00 |
| 10,925,427 | B2 | 2/2021 | Lewis | |
| 2016/0024839 | A1 * | 1/2016 | Ferguson | A47K 17/00 160/351 |
| 2018/0266175 | A1 * | 9/2018 | York | E05D 7/009 |
| 2019/0071922 | A1 * | 3/2019 | Peterson | E06B 7/367 |
| 2020/0069101 | A1 * | 3/2020 | Lewis | F16B 47/00 |

FOREIGN PATENT DOCUMENTS

WO WO-2014151807 A2 * 9/2014 ..... E04B 2/828

* cited by examiner

*Primary Examiner* — Brent W Herring
(74) *Attorney, Agent, or Firm* — Sanchelima & Associates, P.A.; Christian Sanchelima; Jesus Sanchelima

(57) ABSTRACT

A public bathroom door gap cover includes a bathroom assembly, a strip assembly, a cylinder assembly and a clip assembly. The bathroom assembly includes a bathroom door and a stall wall. The strip assembly includes a strip having an elongated shape. The strip is portable and made of a flexible material. The clip assembly is attached to the strip and allows to removably attach the strip to the stall wall. The cylinder assembly includes a power spring that allows retracting the strip to store the strip in the cylinder.

8 Claims, 4 Drawing Sheets

PUBLIC BATHROOM DOOR GAP COVER

BACKGROUND OF THE INVENTION

1. Field of the Invention

The present invention relates to public bathroom door gap covers and, more particularly, to a public bathroom door gap cover that covers the gap between the stall wall and the door of a bathroom.

2. Description of the Related Art

Several designs for public bathroom door gap cover have been designed in the past. None of them, however, include a cover that can be attached to the stall door of a bathroom door and can cover the gap of the door for privacy.

Applicant believes that a related reference corresponds to U.S. Pat. No. 10,925,427 issued for a portable privacy curtain for blocking the gaps in a public restroom toilet stall. Applicant believes that another related reference corresponds to U.S. Pat. No. 8,627,610 issued for a privacy enhancing attachment for covering the gap in a public toilet stall door. None of these references, however, teach of a public bathroom door gap cover that includes a portable elongated rectangular flexible strip of material which can be attached to a public bathroom stall door to cover or block the gap between the stall wall and the door to provide increased privacy and block any view from the outside to the inside of the stall during use.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a public bathroom door gap cover that covers the gap of a public bathroom door for privacy of the user.

It is another object of this invention to provide a public bathroom door gap cover that includes a clip to be easily attached to the public bathroom stall door.

It is still another object of the present invention to provide a public bathroom door gap that can be rolled or unrolled.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
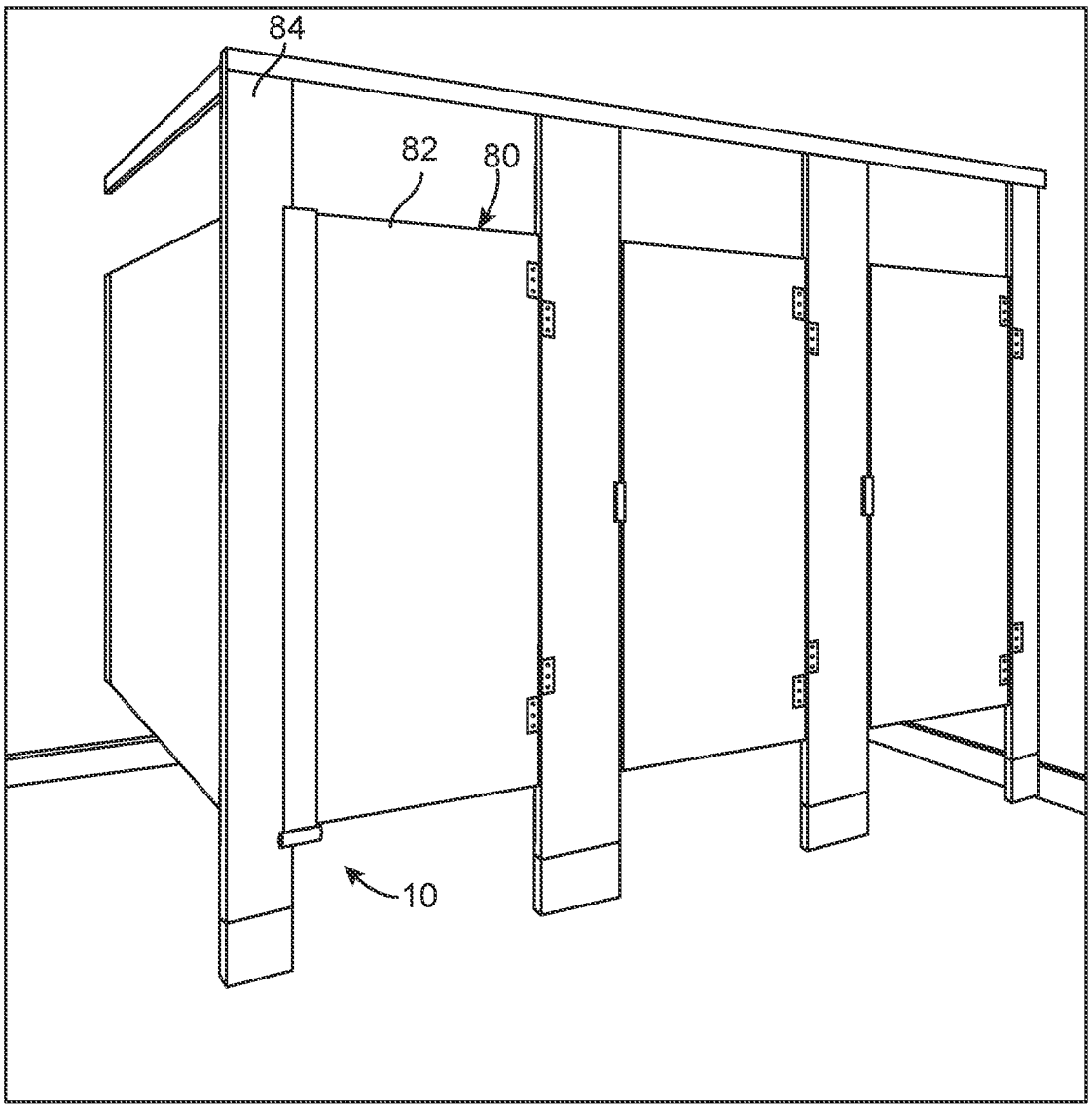
FIG. 1 represents an isometric operational view of the present invention 10. The strip covers a gap between the door 82 and the stall wall 84.
Figure 2:
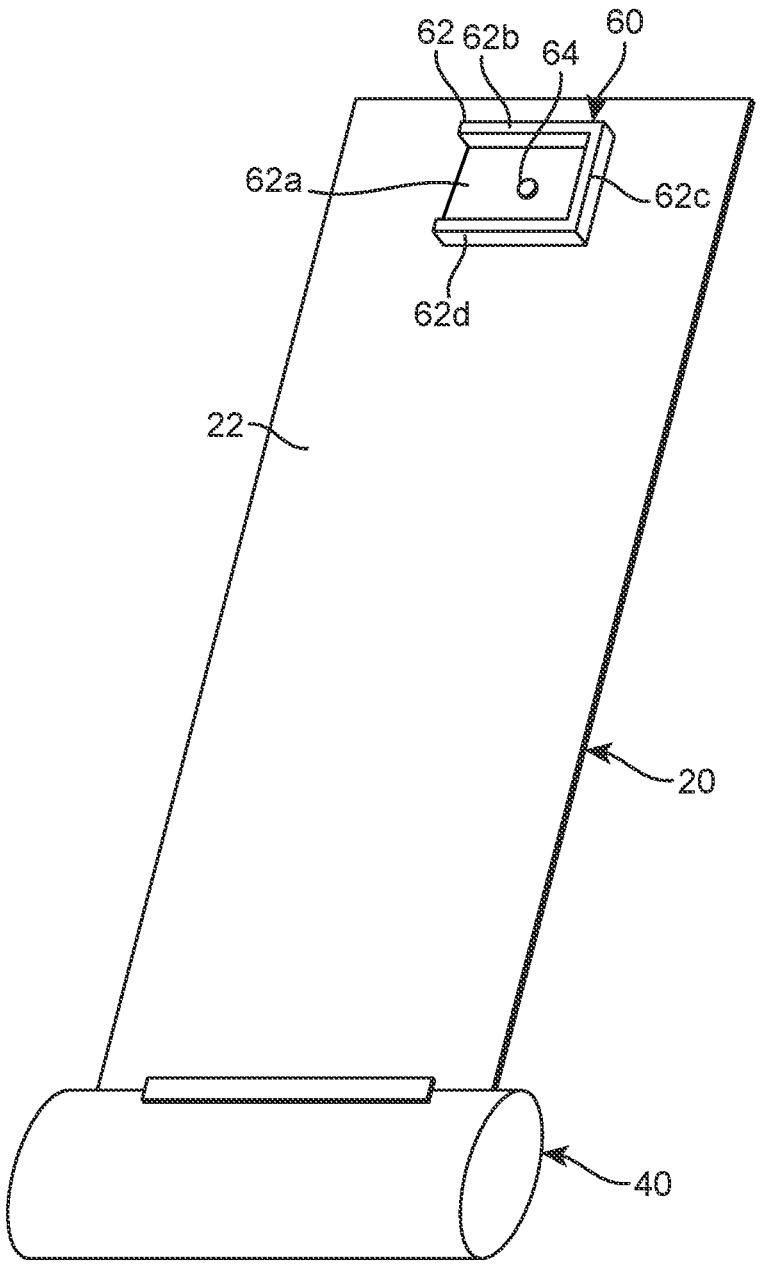
FIG. 2 shows an isometric view of one of the preferred embodiments of the present invention 10 showing the retracting assembly 40 and the strip assembly 20.

Referring now to the drawings, where the present invention is generally referred to with numeral 10, it can be observed that it basically includes a strip assembly 20, a retracting mechanism assembly 40, a clip assembly 60 and a door assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The strip assembly 20 may include strip 22. In one embodiment, the strip 22 may have a top side, a bottom side, a left side and a right side. The top side of the strip 22 may be planar. The bottom side of the strip 22 may also be planar. The top side and bottom side of the strip 22 may have same width. In one embodiment, the top side and bottom side of the strip 22 may have a width of 2.5 inches. It should be understood that the bottom and top sides of the strip 22 may have any other width and shape. The left and right sides of the strip 22 may have same width. The left and right sides of the strip 22 may be planar. The left and right sides of the strip 22 may be perpendicular to the bottom of the strip 22. The bottom and top of the strip 22 may be parallel. The left side and right side of the strip 22 may be parallel. The top and bottom sides of the strip 22 may have a length of 4.5 to 5 feet. It should be understood that the top and bottom sides of the strip 22 may have any other suitable shape. The left, right, top and bottom sides of the strip 22 may define a strip 22 with an elongated rectangular shape. It should be understood that the strip 22 may have any other suitable shape such as elliptical shape, irregular shape, oval shape, ovoid shape, or any variation thereof. The strip 22 may be flexible. The strip 22 may be thin. The strip 22 may be made of a flexible plastic or any other similar material. The strip 22 may be folded or unfolded for easy carrying, storing and transporting. In a preferred embodiment, the strip 22 may have a design of a solid color. It also may be suitable to have the strip 22 having any other design. The strip 22 is portable.

The retracting mechanism assembly 40 may include housing 42. In one embodiment, the housing 42 may have a substantially cylindrical shape. It should be understood that other embodiments of the retracting mechanism assembly 40 may have a housing 42 with a cuboid shape, polygonal prismatic shape, an irregular shape or any variation thereof. The housing 42 may be made of a hard plastic or any other suitable material. The housing 42 may be hollow. The housing may have a slit 42*a* that allows the strip 22 to be stored in the housing 42. The retracting mechanism further includes a power spring 44 embedded inside the housing 42. The power spring 44 may be connected to the strip 22. The power spring 44 may allow the strip 22 to be retracted and stored into the housing 22. The retracting mechanism assembly 40 may further include a latch 46. The latch 46 may be attached to an external surface of the housing 42.

In one embodiment the clip assembly 60 includes clip 62. Clip 62 may have a first base 62*a* with a substantially rectangular shape. Nonetheless, first base 62*a* may have a circular shape, an oval shape, a triangular shape, an elliptical shape, a pentagonal shape, a trapezium shape, or any other suitable shape. The clip 62 may further include a first member 62*b*, a second member 62*c* and third member 62*d*. The first member 62*b* may be located on a top portion of the base 62*a*. The second member 62*c* may be located on a right portion of the base 62*a*. The third member 62*d* may be located on a lower portion of the base 62*d*. The first member 62*b*, second member 62*c* and third member 62*d* may have a cuboid elongated shape. The members may have any other shape. The clip 62 may be attached to the strip 22 using a connector 64. The connector 64 may allow the clip 62 to rotate to fit into a door 82 of the door assembly 80.

Figure 3:
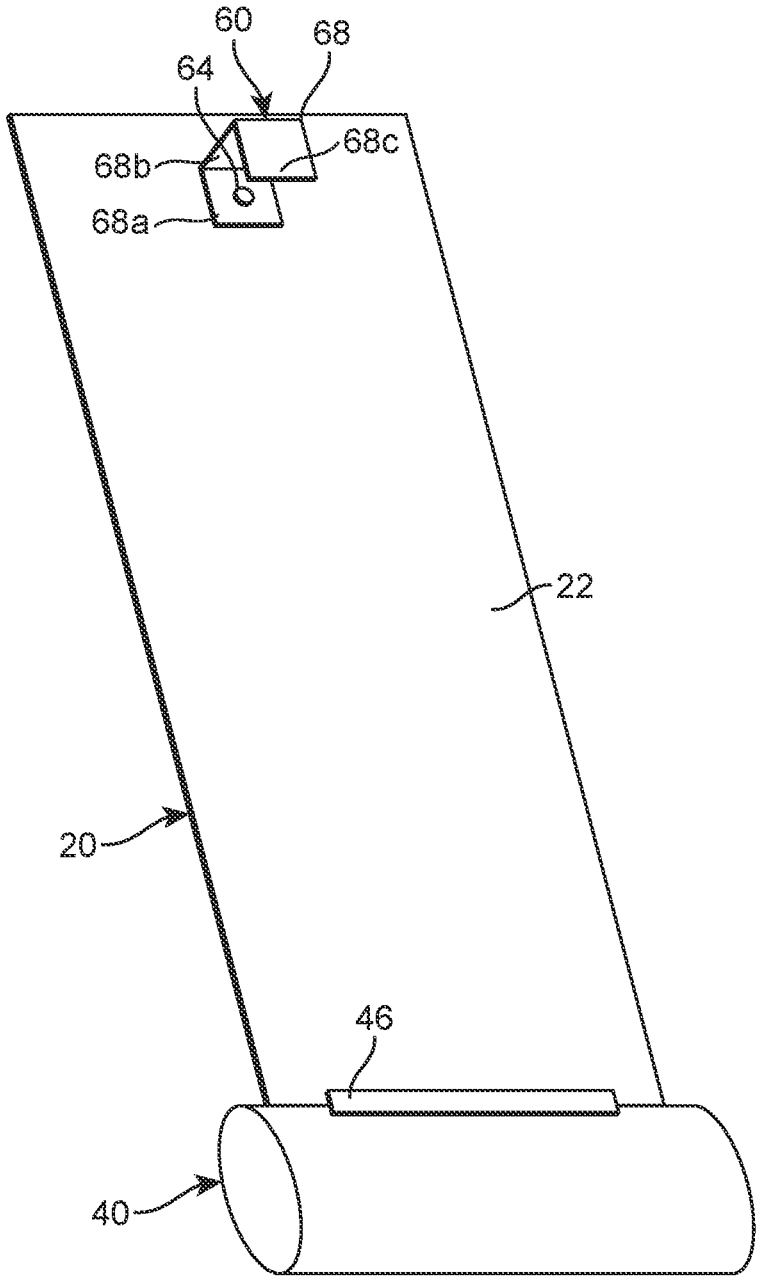
FIG. 3 illustrates an isometric view of an alternative embodiment of the clip assembly 60.
Figure 4:
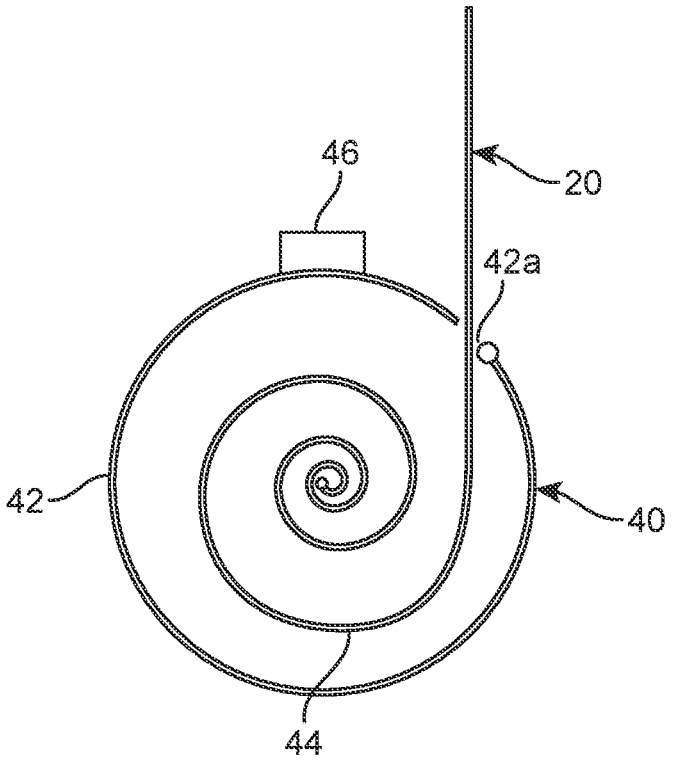
FIG. 4 is a representation of side internal view of the cylinder assembly 40 including a power spring 42 embedded therein, the power spring 42 is connected to the screen assembly 20 to retract the screen.

Best observed in FIG. 3, an alternative embodiment of the clip assembly 60 may include alternative clip 68. Alternative clip 68 may have a first, second and third walls (68*a*, 68*b* and 68*c*). The first, second and third walls (68*a*, 68*b* and 68*c*) may have a substantially rectangular shape. It should be understood that first, second and third walls (68*a*, 68*b* and 68*c*) may have other shapes like a circular shape, oval shape, triangular shape, polygonal shape, irregular shape or any other suitable shape. First wall 68*a* may be perpendicular to the second wall 68*b*. Third wall 68*c* may be parallel and opposite to the first wall 68*a*. First wall 68*a* may be connected to an upper portion of the strip 22 using the connector 64. The connector 64 may allow the alternative clip 68 to rotate to fit into the door 82. The latch 46 may secure the housing 22 to the clip assembly 60 when the strip 22 is retracted. Referring now to FIG. 1, the door assembly 80 may include a door 82 and stall walls 84. Preferably the door 82 may be public bathroom stall doors. It should be understood that the door 82 may be any kind of door having a gap between the door and the stall walls. The strip assembly 20 may be attached to the stall walls using the clip assembly 60 to cover the gap between door 82 and stall wall 84. It should be understood that the present invention is portable and can be used in any door to cover a gap.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A public bathroom door gap cover, comprising:

a bathroom assembly including a door and a stall wall, wherein said door is a public bathroom stall door;

a strip assembly including a strip, said strip is portable and elongated, said strip is made of a flexible material, said strip is attached to the door to cover or block a gap between the stall wall and the public bathroom stall door; and a retracting mechanism assembly, wherein said retracting assembly includes a housing to store said strip when retracted and a power spring, wherein said housing has a cylindrical shape said housing has a slit to receive the strip therein wherein said power spring is connected to said strip, said power spring is capable of retracting said strip.

2. The public bathroom gap cover set forth in claim 1, wherein said strip has a rectangular shape.

3. The public bathroom gap cover set forth in claim 1, further including a clip assembly, said clip assembly includes a clip to removably attach the strip to the door.

4. The public bathroom gap cover set forth in claim 3, wherein said clip is defined by a first wall, a second wall and a third wall connected one to each other.

5. The public bathroom gap cover set forth in claim 3, wherein said clip is connected with a connector to the strip, said connector allows the clip to rotate.

6. The public bathroom gap cover set forth in claim 3, wherein said clip includes a base and a first, a second and a third member, wherein the base is attached to the strip.

7. The public bathroom gap cover set forth in claim 1, wherein said retracting mechanism assembly further includes a latch located at an external surface of said housing.

8. A public bathroom door gap cover, consisting of:

a bathroom assembly including a door and a stall wall, wherein said door is a public bathroom stall door;

a strip assembly including a strip, said strip is portable and elongated, said strip is made of a flexible material, said strip is attached to the door to cover or block a gap between the stall wall and the public bathroom stall door, wherein said strip has a rectangular shape;

a clip assembly, said clip assembly includes a clip to removably attach the strip to the door, wherein said clip is connected with a connector to the strip, said connector allows the clip to rotate; and a retracting mechanism assembly, wherein said retracting assembly includes a housing to store said strip when retracted, wherein said retracting mechanism assembly further includes a power spring connected to said strip, said power spring is capable of retracting said strip, wherein said retracting mechanism assembly further includes a power spring connected to said strip, said power spring is capable of retracting said strip, wherein said retracting mechanism assembly further includes a latch located at an external surface of said housing to secure to the clip assembly for storing.

* * * * *